US010496117B1

(12) United States Patent
Ogura

(10) Patent No.: US 10,496,117 B1
(45) Date of Patent: Dec. 3, 2019

(54) VOLTAGE REGULATOR

(71) Applicant: ABLIC Inc., Chiba-shi, Chiba (JP)

(72) Inventor: Yasuhiko Ogura, Chiba (JP)

(73) Assignee: ABLIC INC., Chiba (JP)

( * ) Notice: Subject to any disclaimer, the term of this patent is extended or adjusted under 35 U.S.C. 154(b) by 0 days.

(21) Appl. No.: 16/413,002

(22) Filed: May 15, 2019

(30) Foreign Application Priority Data

May 16, 2018 (JP) ..... 2018-094527

(51) Int. Cl.
*G05F 1/571* (2006.01)
*G05F 1/575* (2006.01)

(52) U.S. Cl.
CPC ..... *G05F 1/571* (2013.01); *G05F 1/575* (2013.01)

(58) Field of Classification Search
CPC ..... G05F 1/565; G05F 1/569; G05F 1/571; G05F 1/575; H02H 3/20; H02H 3/202
See application file for complete search history.

(56) References Cited

U.S. PATENT DOCUMENTS 7,429,852 B2 * 9/2008 Takagi ..... G05F 1/575 323/275
8,072,198 B2 * 12/2011 Imura ..... G05F 1/56 323/226
8,294,442 B2 * 10/2012 Zhu ..... G05F 1/575 323/274
2008/0211470 A1 * 9/2008 Chiu ..... G05F 1/56 323/273
2014/0070778 A1 3/2014 Nihei et al.

FOREIGN PATENT DOCUMENTS

JP 2014-067394 A 4/2014

* cited by examiner

*Primary Examiner* — Gary L Laxton
(74) *Attorney, Agent, or Firm* — Brinks Gilson & Lione

(57) ABSTRACT

A voltage regulator includes an overshoot detection circuit which detects an overshoot based on an output voltage, an overshoot suppression circuit which controls a gate voltage of an output transistor based on a detection signal of the overshoot detection circuit, a state monitoring circuit which monitors a state of the voltage regulator, a timer circuit which operates the overshoot detection circuit for a preset period in response to a signal of the state monitoring circuit, and a timer off circuit which shortens the preset period counted by the timer circuit in response to the detection of the overshoot.

4 Claims, 3 Drawing Sheets

PRIOR ART

VOLTAGE REGULATOR

RELATED APPLICATIONS

Priority is claimed on Japanese Patent Application No. 2018-094527, filed on May 16, 2018, the content of which is incorporated herein by reference.

BACKGROUND OF THE INVENTION

1. Field of the Invention

The present invention relates to a voltage regulator.

2. Description of the Related Art

A voltage regulator generally has an overshoot suppression circuit suppressing an overshoot of an output voltage to protect a load circuit connected to an output terminal of the voltage regulator. FIG. 3 is a circuit diagram illustrating a voltage regulator having an overshoot suppression circuit in Prior Art described in Japanese Patent Application Laid-Open No. 2014-67394.

The conventional voltage regulator includes an output transistor 5, an error amplifier circuit 6, a voltage dividing resistor circuit 7, a reference voltage circuit 8, a comparison circuit 11, bias circuits 12, 310, and 312, PMOS transistors 311 and 315, NMOS transistors 313 and 316, a ground terminal 1, a power supply terminal 2, and an output terminal 3.

In the conventional voltage regulator, the PMOS transistors 311 and 315, the NMOS transistors 313 and 316, the comparison circuit 11, and the bias circuits 12 and 312 constitutes an overshoot suppression circuit.

In the conventional voltage regulator, the response speed of the overshoot suppression circuit is slow because a current of the bias circuit 12 for the comparison circuit 11 is set small to achieve low current consumption. For this reason, the response speed of the overshoot suppression circuit is made fast by adding a current to the bias circuit 312 upon detection of an increase in the current flowing into the output transistor by the PMOS transistor 315 which serves as an output current sense transistor.

SUMMARY OF THE INVENTION

The conventional voltage regulator has, however, a possibility that reduction of a current of the bias circuit 310 for the error amplifier circuit 6 for the purpose of low power consumption will cause an overshoot at the output terminal 3 by variation of a power supply voltage under a certain condition.

In case the power supply voltage VDD gradually increases from a non-regulation state caused by lowness of the power supply voltage VDD, the response speed of the comparison circuit 11 becomes slow since the drain current of the PMOS transistor 315 starts to decrease. Sudden increase of the power supply voltage VDD under this condition will cause an excessive overshoot at the output terminal 3.

Further, an excessive overshoot occurs at the output terminal 3 at the time of variation in power supply in a regulation state in which a power supply voltage VDD sufficiently higher than a desired output voltage Vout is applied, at the time of turning on of the voltage regulator due to an external signal applied to an ONOFF control terminal though not illustrated in FIG. 3, and so on.

The present invention aims to provide a voltage regulator capable of effectively suppressing an overshoot of an output voltage while being low current consumption.

According to one aspect of the present invention there is provided a voltage regulator having an error amplifier circuit which controls an output transistor so that a feedback voltage based on an output voltage coincides with a reference voltage, and the voltage regulator includes an overshoot detection circuit which detects an overshoot based on the output voltage, an overshoot suppression circuit which controls a gate voltage of the output transistor based on a detection signal of the overshoot detection circuit, a state monitoring circuit which monitors a state of the voltage regulator, a timer circuit which operates the overshoot detection circuit for a preset period in response to a signal of the state monitoring circuit, and a timer off circuit which shortens the preset period counted by the timer circuit in response to the detection of the overshoot.

According to a voltage regulator of the present invention, since the voltage regulator has a state monitoring circuit, a timer circuit, and a timer off circuit, it is capable of effectively suppressing an overshoot of an output voltage while being low current consumption.

DETAILED DESCRIPTION OF THE PREFERRED EMBODIMENTS

Embodiments of the present invention will hereinafter be described with reference to the accompanying drawings.

Figure 1:
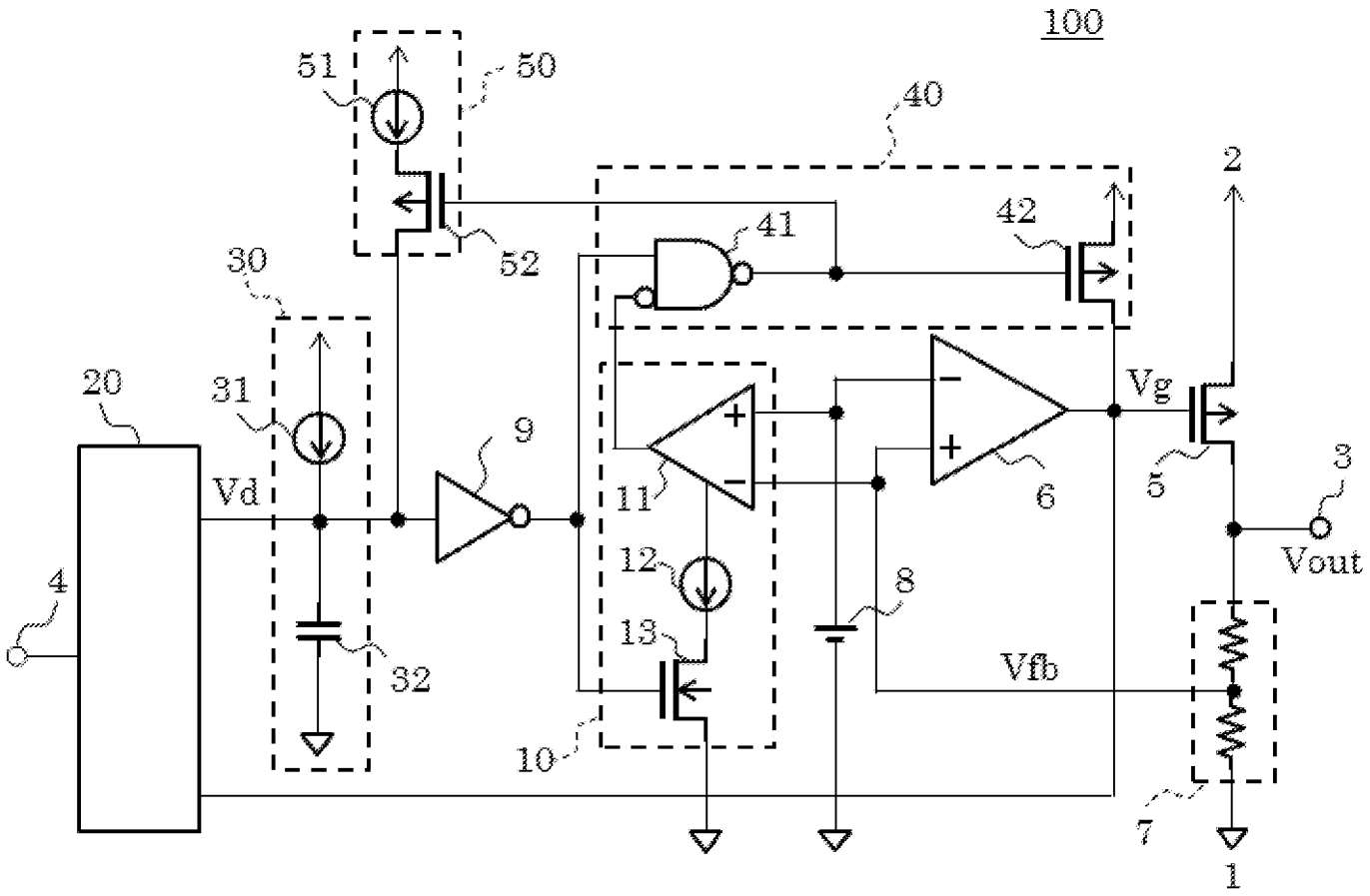
FIG. 1 is a circuit diagram illustrating a voltage regulator according to an embodiment of the present invention.

FIG. 1 is a circuit diagram illustrating a voltage regulator according to an embodiment of the present invention.

The voltage regulator 100 according to the present embodiment includes an output transistor 5, an error amplifier circuit 6, a voltage dividing resistor circuit 7, a reference voltage circuit 8, a NOT circuit 9, an overshoot detection circuit 10, a state monitoring circuit 20, a timer circuit 30, an overshoot suppression circuit 40, and a timer off circuit 50.

The overshoot detection circuit 10 includes an amplifier 11, a bias circuit 12, and an NMOS transistor 13. The timer circuit 30 has a constant current source 31 and a capacitor 32. The overshoot suppression circuit 40 has a NAND circuit 41 and a PMOS transistor 42. The timer off circuit 50 has a constant current source 51 and a PMOS transistor 52. Although not illustrated in the drawing, a control terminal 4 is connected to, for example, a circuit which controls a bias circuit for the error amplifier circuit 6 and receives therein a signal for performing ONOFF control of the voltage regulator 100.

Figure 2:
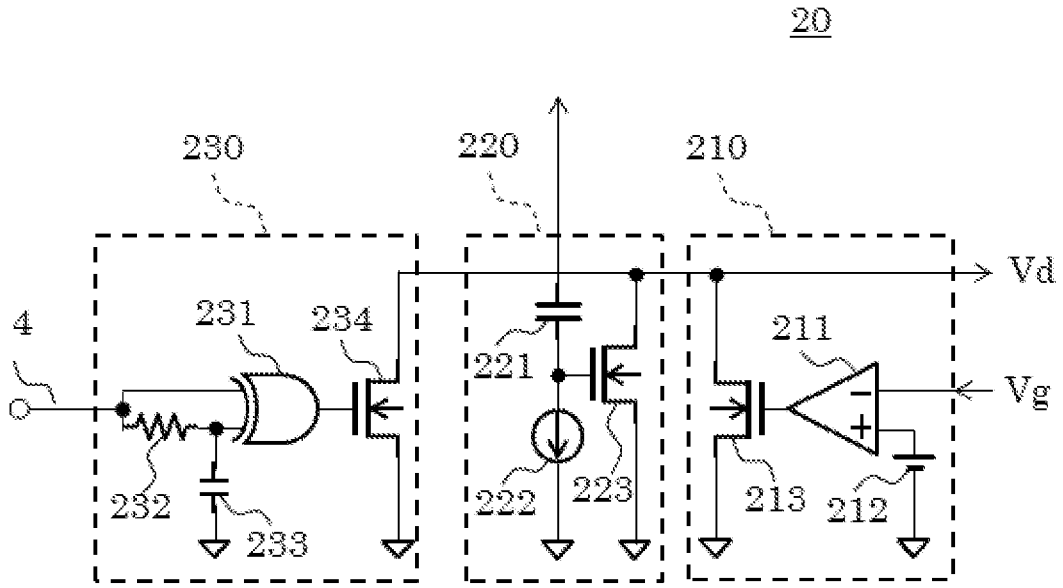
FIG. 2 is a circuit diagram illustrating an example of a state monitoring circuit of the voltage regulator according to the present embodiment.
Figure 3:
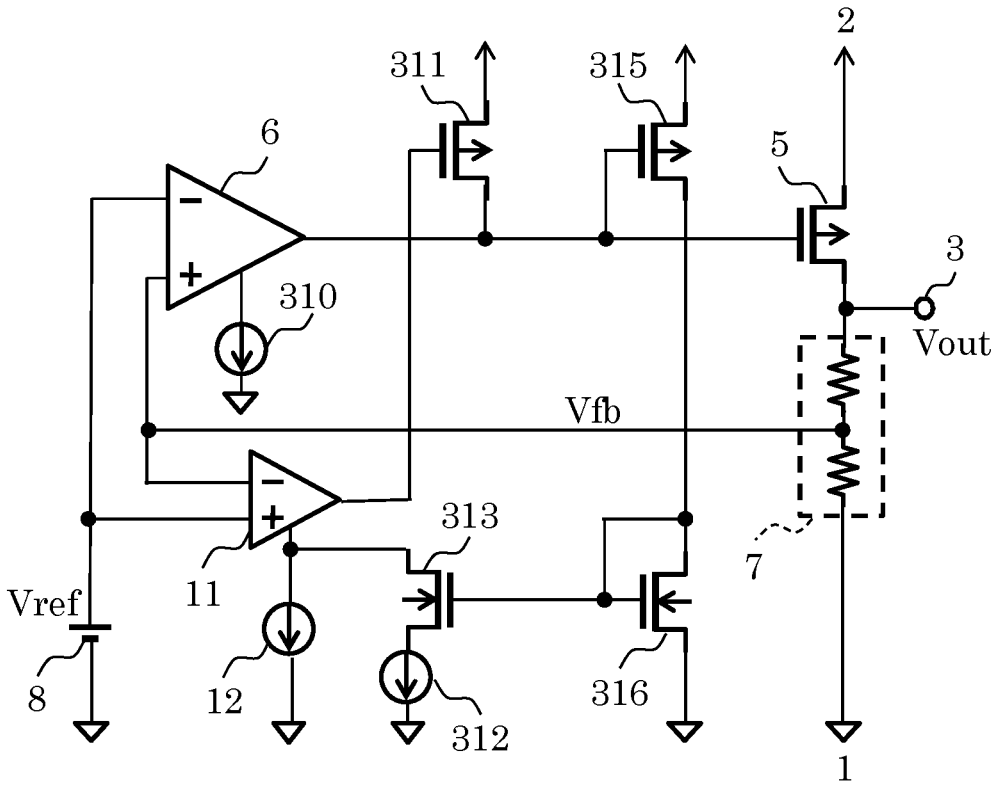
FIG. 3 is a circuit diagram illustrating a voltage regulator in Prior Art.

FIG. 2 is a circuit diagram illustrating an example of the state monitoring circuit 20 in the present embodiment.

The state monitoring circuit 20 includes a non-regulation detection circuit 210, a power supply variation detection circuit 220, and an input detection circuit 230. The non-regulation detection circuit 210 has an amplifier 211, a constant voltage circuit 212, and an NMOS transistor 213. The power supply variation detection circuit 220 has a capacitor 221, a constant current source 222, and an NMOS transistor 223. The input detection circuit 230 has an XOR circuit 231, a resistor 232, a capacitor 233, and an NMOS transistor 234. A detection state in any of the detection circuits gives Lo to the voltage Vd of an output terminal of the state monitoring circuit 20, and a non-detection state in all the detection circuits gives high impedance.

In FIG. 1 the error amplifier circuit 6 has an inversion input terminal to which a positive polarity terminal of the reference voltage circuit 8 is connected, a non-inversion input terminal to which an output terminal of the voltage dividing resistor circuit 7 is connected, and an output terminal connected to a gate of the output transistor 5. The output transistor 5 has a source connected to a power supply terminal 2 and a drain connected to the output terminal 3. The voltage dividing resistor circuit 7 is connected between the output terminal 3 and the ground terminal 1.

The amplifier 11 has a non-inversion input terminal to which the positive polarity terminal of the reference voltage circuit 8 is connected, and an inversion input terminal to which the output terminal of the voltage dividing resistor circuit 7 is connected. The bias circuit 12 and the NMOS transistor 13 are connected in series between the amplifier 11 and the ground terminal 1.

The state monitoring circuit 20 has a first input terminal to which the control terminal 4 is connected, a second input terminal to which the output terminal of the error amplifier circuit 6 is connected, and an output terminal connected to an input terminal of the NOT circuit 9 through the timer circuit 30. In the timer circuit 30, the constant current source 31 and the capacitor 32 are connected in series between the power supply terminal 2 and the ground terminal 1, and a connecting point therebetween is connected to the output terminal of the state monitoring circuit 20 and the input terminal of the NOT circuit 9. The NOT circuit 9 has an output terminal connected to a gate of the NMOS transistor 13 and an input terminal of the NAND circuit 41.

The NAND circuit 41 has the other input terminal to which an output terminal of the amplifier 11 is connected, and an output terminal connected to a gate of the PMOS transistor 42. The PMOS transistor 42 has a source connected to the power supply terminal 2 and a drain connected to a gate of the output transistor 5.

In the timer off circuit 50, the constant current source 51 and the PMOS transistor 52 are connected in series between the power supply terminal 2 and the input terminal of the NOT circuit 9. The PMOS transistor 52 has a gate connected to the output terminal of the NAND circuit 41.

As shown in FIG. 2 the amplifier 211 has a non-inversion input terminal to which a positive polarity terminal of the constant voltage circuit 212 is connected, an inversion input terminal to which the output terminal of the error amplifier circuit 6 is connected, and an output terminal connected to a gate of the NMOS transistor 213. The NMOS transistor 213 has a drain connected to the output terminal of the state monitoring circuit 20 and a source connected to the ground terminal 1.

The capacitor 221 and the constant current source 222 are connected in series between the power supply terminal 2 and the ground terminal 1, and a connecting point therebetween is connected to a gate of the NMOS transistor 223. The NMOS transistor 223 has a drain connected to the output terminal of the state monitoring circuit 20 and a source connected to the ground terminal 1.

The XOR circuit 231 has one input terminal to which a first input terminal is connected, the other input terminal to which a connecting point of the resistor 232 and the capacitor 233 connected in series between the first input terminal and the ground terminal 1 is connected, and an output terminal connected to a gate of the NMOS transistor 234. The NMOS transistor 234 has a drain connected to the output terminal of the state monitoring circuit 20 and a source connected to the ground terminal 1.

The operation of the voltage regulator 100 will be described.

The voltage regulator 100 supplies an output voltage Vout from the output terminal 3 in response to input of a power supply voltage VDD to the power supply terminal 2 and a signal Hi to the control terminal 4. The voltage dividing resistor circuit 7 divides the output voltage Vout to provide a divided voltage Vfb. The error amplifier circuit 6 compares a reference voltage Vref of the reference voltage circuit 8 and the divided voltage Vfb and controls the gate voltage of the output transistor 5 so that the output voltage Vout becomes constant.

A description will next be made as to the operation of the voltage regulator 100 at a detection of the signal of the control terminal 4 by the input detection circuit 230 of the state monitoring circuit 20.

Although not illustrated in the drawing, the error amplifier circuit 6 and the output transistor 5 are controlled to turn off during input of a signal of Lo to the control terminal 4. The voltage regulator 100 therefore does not supply the voltage from the output terminal 3 even if the power supply voltage VDD is supplied to the power supply terminal 2.

In response to input of a signal of Hi to the control terminal 4, the error amplifier circuit 6 turns on to control the gate voltage of the output transistor 5 to hold the output voltage Vout constant. Further, in response to input of the signal of Hi to the input terminal of the input detection circuit 230, the input detection circuit 230 supplies a pulse signal of Lo only for a preset period of a time constant set by the resistor 232 and the capacitor 233 in synchronization with the rising of the Hi signal. Then, the state monitoring circuit 20 makes the voltage Vd of the output terminal to be Lo during the pulse signal of Lo.

The timer circuit 30 provides Lo by the input of the voltage Vd of Lo which discharges the electric charge in the capacitor 32 and goes Hi after gradual increase of the output voltage by the input of high impedance which starts charging of the capacitor 32 by the current from the constant current source 31. In response to the output voltage of Lo from the timer circuit, the NOT circuit 9 provides Hi to turn on the NMOS transistor 13. Since the current of the bias circuit 12 for the amplifier 11 thereby flows, the overshoot detection circuit 10 starts operation. Further, since the output signal from the overshoot detection circuit 10 is made effective by the output of Hi from the NOT circuit 9, the overshoot suppression circuit 40 enters an operable state.

Since the divided voltage Vfb supplied to the amplifier 11 becomes higher than the reference voltage Vref by the generation of an overshoot at the output terminal 3, the overshoot detection circuit 10 provides an Lo signal indicative of overshoot detection. In the overshoot suppression circuit 40, since the NAND circuit 41 provides the Lo signal, the PMOS transistor 42 turns on to raise a voltage Vg of the gate of the output transistor 5 to Hi, thereby suppressing the overshoot of the output terminal 3.

Here, the overshoot detection circuit 10 and the overshoot suppression circuit 40 continue the operation until the output voltage of the timer circuit 30 exceeds a threshold voltage of the NOT circuit 9. The timer circuit 30 sets a counting time to be long to some extent so as to be adaptable to the case where the power supply voltage gradually increases. For this reason, at a detection of the signal of the control terminal 4 by the input detection circuit 230, and at a detection of variation in the power supply voltage VDD, which is described later, etc., the overshoot often generates immediately after the state monitoring circuit 20 detects them, thus resulting in a flow of useless current in the overshoot detection circuit 10.

In the timer off circuit 50, the PMOS transistor 52 turns on in response to the Lo signal supplied from the NAND circuit 41 of the overshoot suppression circuit 40 to feed a current of the current source 51 to the timer circuit 30. Since the capacitor 32 is charged with the current of the current source 31 and the current of the current source 51, the counting time of the timer circuit 30 becomes shorter. That is, earlier turning off the overshoot detection circuit 10 can reduce the current consumption.

As described above, since the input detection circuit 230 is provided, the voltage regulator having ONOFF control is also capable of effectively suppressing the overshoot of the output terminal 3 while being low current consumption.

A description will next be made as to the operation of the voltage regulator 100 at a detection of a variation in the power supply by the power supply variation detection circuit 220 of the state monitoring circuit 20. Incidentally, the description after the state monitoring circuit 20 provides the voltage Vd of Lo to the output terminal will be omitted subsequently.

With a sudden increase in the power supply voltage VDD in a regulation state of the voltage regulator 100, the voltage of the connecting point between the capacitor 221 and the constant current source 222 in the power supply variation detection circuit 220 rises to turn on the NMOS transistor 223. Consequently, the state monitoring circuit 20 provides a voltage Vd of Lo indicative of a detection state to the output terminal.

Also, with the rise of the power supply voltage VDD from OV to a preset voltage, the voltage of the connecting point between the capacitor 221 and the constant current source 222 in the power supply variation detection circuit 220 rises to turn on the NMOS transistor 223. Consequently, the state monitoring circuit 20 provides a voltage Vd of Lo indicative of a detection state to the output terminal.

A description will next be made as to the operation of the voltage regulator 100 at a detection of a non-regulation state by the non-regulation detection circuit 210 of the state monitoring circuit 20.

In the non-regulation state, the error amplifier circuit 6 controls the voltage Vg of the gate of the output transistor 5 to Lo in such a manner that the output voltage Vout of the output terminal 3 becomes high. Since the voltage Vg of Lo is applied to the inversion input terminal of the amplifier 211, the amplifier 211 supplies a voltage of Hi through the output terminal thereof to turn on the NMOS transistor 213. The state monitoring circuit 20 therefore provides a voltage Vd of Lo indicative of a detection state to the output terminal thereof.

As described above, since the voltage regulator 100 of the present invention includes the state monitoring circuit 20 having the non-regulation detection circuit 210, the power supply variation detection circuit 220, and the input detection circuit 230, the timer circuit 30, and the timer off circuit 50, the voltage regulator 100 is capable of effectively suppressing the overshoot of the output voltage while being low current consumption.

Although the embodiment of the present invention has been described above, the present invention is not limited to the above embodiment. It is needless to say that various changes can be made thereto within the scope not departing from the gist of the present invention.

For example, although the above embodiment has described that the timer off circuit 50 operates based on the output signal of the NAND circuit 41, the timer off circuit 50 may operate based on the output signal of the comparison circuit 11, or the like. Also, for example, the non-regulation detection circuit 210, the power supply variation detection circuit 220, and the input detection circuit 230 are illustrated as an example in terms of the circuits illustrated in FIG. 2. They are not limited thereto as long as they are respectively a circuit which achieves a desired function. Further, for example, the state monitoring circuit 20 may have any one of the non-regulation detection circuit 210, the power supply variation detection circuit 220, and the input detection circuit 230 or two thereof.

What is claimed is:

1. A voltage regulator having an error amplifier circuit which controls an output transistor so that a feedback voltage based on an output voltage coincides with a reference voltage, the voltage regulator comprising:

an overshoot detection circuit configured to detect an overshoot, based on the output voltage;

an overshoot suppression circuit configured to control a gate voltage of the output transistor, based on a detection signal of the overshoot detection circuit;

a state monitoring circuit configured to monitor a state of the voltage regulator;

a timer circuit configured to operate the overshoot detection circuit for a preset period in response to a signal of the state monitoring circuit; and a timer off circuit configured to shorten the preset period counted by the timer circuit in response to the detection of the overshoot.

2. The voltage regulator according to claim 1, wherein the state monitoring circuit comprises at least either a non-regulation detection circuit or a power supply variation detection circuit.

3. The voltage regulator according to claim 1, further comprising a control terminal configured to receive an ONOFF signal, wherein the state monitoring circuit comprises an input detection circuit configured to detect the ONOFF signal.

4. The voltage regulator according to claim 2, further comprising a control terminal configured to receive an ONOFF signal, wherein the state monitoring circuit comprises an input detection circuit configured to detect the ONOFF signal.

* * * * *